US007057592B2

(12) United States Patent
Park

(10) Patent No.: US 7,057,592 B2
(45) Date of Patent: Jun. 6, 2006

(54) LIQUID CRYSTAL DISPLAY DEVICE AND DRIVING METHOD THEREOF

(75) Inventor: Kwang Soon Park, Daegu-kwangyokshi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 282 days.

(21) Appl. No.: 10/419,928

(22) Filed: Apr. 22, 2003

(65) Prior Publication Data

US 2004/0135752 A1 Jul. 15, 2004

(30) Foreign Application Priority Data

Dec. 20, 2002 (KR) ..... 10-2002-0081982

(51) Int. Cl.
*G09G 3/36* (2006.01)

(52) U.S. Cl. ..... 345/87; 345/92

(58) Field of Classification Search ..... 345/84, 345/87, 90, 91, 92, 93, 94, 98, 99, 100, 103, 345/204, 83

See application file for complete search history.

(56) References Cited

U.S. PATENT DOCUMENTS 5,701,166 A * 12/1997 Fedorovish et al. ..... 349/38
6,310,594 B1 * 10/2001 Libsch et al. ..... 345/90
6,421,037 B1 * 7/2002 Chen ..... 345/92
6,476,785 B1 * 11/2002 Pathak et al. ..... 345/90
6,724,359 B1 * 4/2004 Yamamoto et al. ..... 345/92
2003/0063056 A1 * 4/2003 Frazee et al. ..... 345/87
2003/0189537 A1 * 10/2003 Yun ..... 345/87
2003/0197826 A1 * 10/2003 Yun et al. ..... 349/149

* cited by examiner

*Primary Examiner*—Bipin Shalwala
*Assistant Examiner*—Nitin Patel
(74) *Attorney, Agent, or Firm*—McKenna Long & Aldridge LLP

(57) ABSTRACT

A liquid crystal display device and a driving method thereof are disclosed in the present invention. The liquid crystal display device includes a plurality of data lines, a plurality of gate lines crossing the data lines, a first liquid crystal cell on a first side of the data lines, a second liquid crystal cell on a second side of the data lines, a first switching part applying a first video signal supplied to the data lines to the first liquid crystal cell, a second switching part applying a second video signal supplied to the data lines to the second liquid crystal cell, and a voltage dropping device in the second switching part charging a voltage in the first liquid crystal cell the same as the second liquid crystal cell, when the same video signal is applied to the first liquid crystal cell and the second liquid crystal cell.

37 Claims, 8 Drawing Sheets

LIQUID CRYSTAL DISPLAY DEVICE AND DRIVING METHOD THEREOF

This application claims the benefit of the Korean Patent Application No. P2002-081982 filed on Dec. 20, 2002, which is hereby incorporated by reference.

BACKGROUND OF THE INVENTION

1. Field of the Invention

The present invention relates to a liquid crystal display device, and more particularly, to a liquid crystal display device and a driving method thereof. Although the present invention is suitable for a wide scope of applications, it is particularly suitable for charging uniform voltage to liquid crystal cells as well as reducing the number of data lines.

2. Discussion of the Related Art

A liquid crystal display controls light transmittance of liquid crystals by using an electric field to display a picture. To this end, the liquid crystal display includes a liquid crystal display panel having a pixel matrix and a driving circuit for driving the liquid crystal display panel. The driving circuit drives the pixel matrix so that picture information can be displayed on the display panel.

FIG. 1 illustrates a related art liquid crystal display.

Referring to FIG. 1, the related art liquid crystal display includes a liquid crystal display panel 2, a data driver 4 driving a plurality of data lines DL1 to DLm of the liquid crystal display panel 2, a gate driver 6 driving a plurality of gate lines GL1 to GLn of the liquid crystal display panel.

The liquid crystal display panel 2 further includes a thin film transistor TFT formed at each intersection of the gate lines GL1 to GLn and the data line DL1 to DLm, and liquid crystal cells connected to the thin film transistors and arranged in a matrix.

The gate driver 6 sequentially applies gate signals to the gate lines GL1 to GLn in accordance with control signals from a timing controller (not shown). The data driver 4 converts data R, G, and B supplied from the timing controller into video signals as analog signals, and applies the video signals of one horizontal line portion to the data lines DL1 to DLm for each horizontal period when the gate signals are applied to the gate lines GL1 to GLn.

The thin film transistor TFT applies data from the data lines DL1 to DLm to the liquid crystal cells in response to the gate signals from the gate lines GL1 to GLn. The liquid crystal cell is composed of a pixel electrode connected to the TFT and a common electrode facing into each other with the liquid crystal therebetween, thus it can be expressed equivalent to a liquid crystal capacitor Clc. Such a liquid crystal cell includes a storage capacitor (not shown) connected to the previous gate line in order to sustain the data voltage charged in the liquid crystal capacitor Clc until the next data voltage is charged.

In this way, the liquid crystal cells of the related art liquid crystal display panel are located at intersections of the gate lines GL1 to GLn and the data lines DL1 to DLm, respectively. Thus, there are vertical lines formed as many as the data lines DL1 to DLm (i.e., m vertical lines). In other words, the liquid crystal cells are arranged in a matrix to form m vertical lines and n horizontal lines.

As can be seen here, the m data lines DL1 to DLm are required for driving the liquid crystal cells of the m horizontal lines. Accordingly, there is a disadvantage in that the processing time and fabricating cost are not efficient because a plurality of data lines DL1 to DLm are formed for driving the liquid crystal display panel 2 in the related art. Further, there is a problem in that the fabricating cost becomes high because a number of data driver IC's are required in the data driver 4 for driving each of the m data lines DL1 to DLm.

SUMMARY OF THE INVENTION

Accordingly, the present invention is directed to a liquid crystal display device and a driving method thereof that substantially obviate one or more of problems due to limitations and disadvantages of the related art.

Another object of the present invention is to provide a liquid crystal display device and a driving method thereof that are adaptive for charging uniform voltage to liquid crystal cells as well as reducing the number of data lines.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a plurality of data lines, a plurality of gate lines crossing the data lines, a first liquid crystal cell on a first side of the data lines, a second liquid crystal cell on a second side the data lines, a first switching part applying a first video signal supplied to the data lines to the first liquid crystal cell, a second switching part applying a second video signal supplied to the data lines to the second liquid crystal cell, and a voltage dropping device in the second switching part charging a voltage in the first liquid crystal cell the same as the second liquid crystal cell, when the same video signal is applied to the first liquid crystal cell and the second liquid crystal cell.

Herein, the first switching part includes a first thin film transistor having a first gate terminal connected to the $i^{th}$ (wherein i is a natural number) gate line and a first source terminal connected to the $(i+1)^{th}$ gate line, and a second thin film transistor having a second gate terminal connected to a first drain terminal of the first thin film transistor, a second source terminal connected to the data lines, and a second drain terminal connected to the first liquid crystal cell.

Herein, the second switching part includes a third thin film transistor acting as the voltage dropping device and having a third source terminal and a third gate terminal connected to the $i^{th}$ gate line, and a fourth thin film transistor having a fourth gate terminal connected to a third drain terminal of the third thin film transistor, a fourth source terminal connected to the data lines, and a fourth drain terminal connected to the second liquid crystal cell.

Herein, the first thin film transistor is turned on to apply a second gate signal to the second thin film transistor, when a first gate signal is applied to the $i^{th}$ gate line and the second gate signal is applied to the $(i+1)^{th}$ gate line.

Herein, the third thin film transistor is turned on to apply a first gate signal to the fourth thin film transistor, when the first gate signal is applied to the $i^{th}$ gate line.

Herein, the third thin film transistor drops a voltage of the first gate signal applied to the fourth thin film transistor to be equal to the voltage of the second gate signal applied to the second thin film transistor.

Herein, the voltage of the first gate signal is controlled by a channel width of the third thin film transistor.

Herein, the second switching part includes a third thin film transistor having a third source terminal connected to the data lines and a third drain terminal connected to the second liquid crystal cell, and a diode acting as the voltage dropping device and connected between the $i^{th}$ gate line and a third gate terminal of the third thin film transistor.

Herein, the diode provides the third thin film transistor with a gate signal supplied to the $i^{th}$ gate line.

Herein, the first switching part is located on the first side of the data lines.

Herein, the second switching part is located on the second side of the data lines.

Herein, each of the first and second thin film transistors includes a gate electrode on a substrate, a gate insulating layer on the gate electrode, a semiconductor layer on the gate insulating layer, a source electrode and a drain electrode on the semiconductor layer, and a protective layer formed on the source electrode and the drain electrode.

Herein, the semiconductor layer includes an undoped active layer on the gate insulating layer, and a doped ohmic contact layer on the active layer.

Herein, the semiconductor layer, the source electrode, and the drain electrode are formed with the same mask.

Herein, the semiconductor layer, the source electrode, and the drain electrode are formed with different masks.

Herein, each of the third and fourth thin film transistors includes a gate electrode on a substrate, a gate insulating layer on the gate electrode, a semiconductor layer on the gate insulating layer, a source electrode and a drain electrode on the semiconductor layer, and a protective layer formed on the source electrode and the drain electrode.

Herein, the semiconductor layer includes an undoped active layer on the gate insulating layer, and a doped ohmic contact layer on the active layer.

Herein, the semiconductor layer, the source electrode, and the drain electrode are formed with the same mask.

Herein, the semiconductor layer, the source electrode, and the drain electrode are formed with different masks.

In another aspect of the present invention, a liquid crystal display includes a plurality of data lines, a plurality of gate lines crossing the data lines, a first liquid crystal cell formed on a first side of the data lines, a second liquid crystal cell formed on a second side the data lines, a first switching part including a first thin film transistor and a second thin film transistor applying a video signal supplied to the data lines to the first liquid crystal cell, and a second switching part including a third thin film transistor and a fourth thin film transistor applying the video signal supplied to the data lines to the second liquid crystal cell, wherein the first switching part and the second switching part are symmetrical with each other except for a connection to source terminals of the first and third thin film transistors.

Herein, the first thin film transistor has a first gate terminal connected to the $i^{th}$ (wherein i is a natural number) gate line and a first source terminal connected to the $(i+1)^{th}$ gate line.

Herein, the second thin film transistor has a second gate terminal connected to a first drain terminal of the first thin film transistor, a second source terminal connected to the data lines and a second drain terminal connected to the first liquid crystal cell.

Herein, the third thin film transistor has a third gate terminal and a third source terminal connected the $i^{th}$ (wherein i is a natural number) gate line.

Herein, the fourth thin film transistor has a fourth gate terminal connected to a third drain terminal of the third thin film transistor, a fourth source terminal connected to the data lines, and a fourth drain terminal connected to the second liquid crystal cell.

Herein, the first liquid crystal cell and the first switching part are formed in odd-numbered vertical lines, and the second liquid crystal cell and the second switching part are formed in even-numbered vertical lines.

Herein, the second liquid crystal cell and the second switching part are formed in odd-numbered vertical lines, and the first liquid crystal cell and the first switching part are formed in even-numbered vertical lines.

Herein, each of the first to fourth thin film transistors includes a gate electrode on a substrate, a gate insulating layer on the gate electrode, a semiconductor layer on the gate insulating layer, a source electrode and a drain electrode on the semiconductor layer, and a protective layer on the source electrode and the drain electrode.

Herein, the semiconductor layer includes an undoped active layer on the gate insulating layer, and a doped ohmic contact layer on the active layer.

Herein, the semiconductor layer, the source electrode, and the drain electrode are formed with the same mask.

Herein, the semiconductor layer, the source electrode, and the drain electrode are formed with different masks.

In another aspect of the present invention, a liquid crystal display device includes a plurality of data lines, a plurality of gate lines crossing the data lines, a first liquid crystal cell on a first side of the data lines, a second liquid crystal cell on a second side of the data lines, a first switching part including a first thin film transistor connected to the $i^{th}$ (wherein i is a natural number) gate line and the $(i+1)^{th}$ gate line, and a second thin film transistor connected to the first thin film transistor applying a video signal from the data lines to the first liquid crystal cell, and a second switching part including a third thin film transistor connected to the $i^{th}$ gate line, and a fourth thin film transistor connected to the third thin film transistor applying a video signal from the data lines to the second liquid crystal cell, wherein a channel width of the third thin film transistor is adjusted, so that a voltage charged in the first liquid crystal cell is the same as the voltage charged in the second liquid crystal cell, when the first and second liquid crystal cells are supplied with the same video signal.

In another aspect of the present invention, a liquid crystal display includes a plurality of data lines, a plurality of gate lines crossing the data lines, a first liquid crystal cell on a first side of the data lines, a second liquid crystal cell on a second side of the data lines, a first switching part including a first thin film transistor connected to the $i^{th}$ (wherein i is a natural number) gate line and the $(i+1)^{th}$ gate line, and a second thin film transistor connected to the first thin film transistor applying a video signal from the data lines to the first liquid crystal cell, and a second switching part including a third thin film transistor connected to the $i^{th}$ gate line, and a fourth thin film transistor connected to the third thin film transistor applying the video signal from the data lines to the second liquid crystal cell, wherein the first switching part and the second switching part are alternately arranged with respect to the data lines.

Herein, the first liquid crystal cell and the first switching part are located in odd-numbered vertical lines of even-numbered horizontal lines, and the second liquid crystal cell and the second switching part are located in even-numbered vertical lines of even-numbered horizontal lines.

Herein, the first liquid crystal cell and the first switching part are located in even-numbered vertical lines of odd-numbered horizontal lines, and the second liquid crystal cell and the second switching part are located in odd-numbered vertical lines of odd-numbered horizontal lines.

Herein, the first liquid crystal cell and the first switching part are located in odd-numbered vertical lines of odd-numbered horizontal lines, and the second liquid crystal cell and the second switching part are located in even-numbered vertical lines of odd-numbered horizontal lines.

Herein, the first liquid crystal cell and the first switching part are located in even-numbered vertical lines of even-numbered horizontal lines, and the second liquid crystal cell and the second switching part are located in odd-numbered vertical lines of even-numbered horizontal lines.

In a further aspect of the present invention, a method of driving a liquid crystal display device includes applying a video signal supplied from a data line in a first switching part to a first liquid crystal cell, when a gate signal is applied to the $i^{th}$ gate line and the $(i+1)^{th}$ gate line, applying the video signal supplied from the data line in a second switching part to a second liquid crystal cell, when the gate signal is applied to the $i^{th}$ gate line, and dropping a voltage of the $i^{th}$ gate signal applied from the second switching part for supplying a uniform video signal to the first and second liquid crystal cells.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 2:
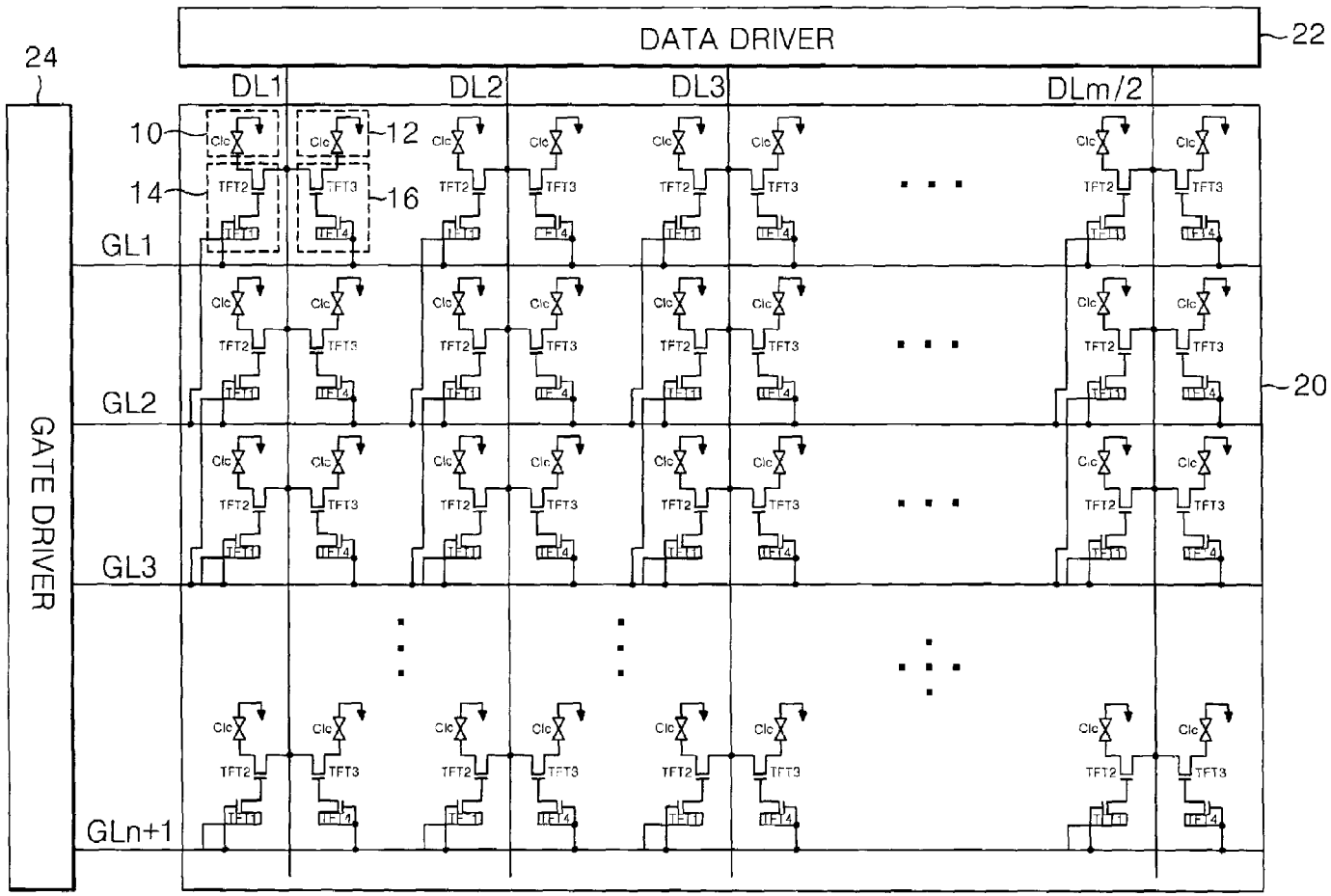
FIG. 2 illustrates a schematic view of a liquid crystal display device according to a first embodiment of the present invention.

FIG. 2 illustrates a schematic view of a liquid crystal display device according to a first embodiment of the present invention.

Referring to FIG. 2, the liquid crystal display device according to the first embodiment of the present invention includes a liquid crystal display panel 20, a data driver 22 driving data lines DL1 to DLm/2 of the liquid crystal display panel 20, and a gate driver 24 driving gate lines GL1 to GLn+1 of the liquid crystal display panel 20.

More specifically, the liquid crystal display panel 20 includes first liquid crystal cells 10 and second liquid crystal cells 12 formed at the intersections of the gate lines GL1 to GLn+1 and the data lines DL1 to DLm/2, first switching parts 14 driving the first liquid crystal cells 10, and second switching parts 16 driving the second liquid crystal cells 12. The first liquid crystal cells 10 and the second liquid crystal cells 12 are composed of a pixel electrode connected to the first switching part 14 and the second switching part 16, respectively, and a pair of common electrodes facing into each other and having liquid crystal therebetween. Therefore, the liquid crystal cells can be expressed to be equivalent to a liquid crystal capacitor Clc.

Figure 1:
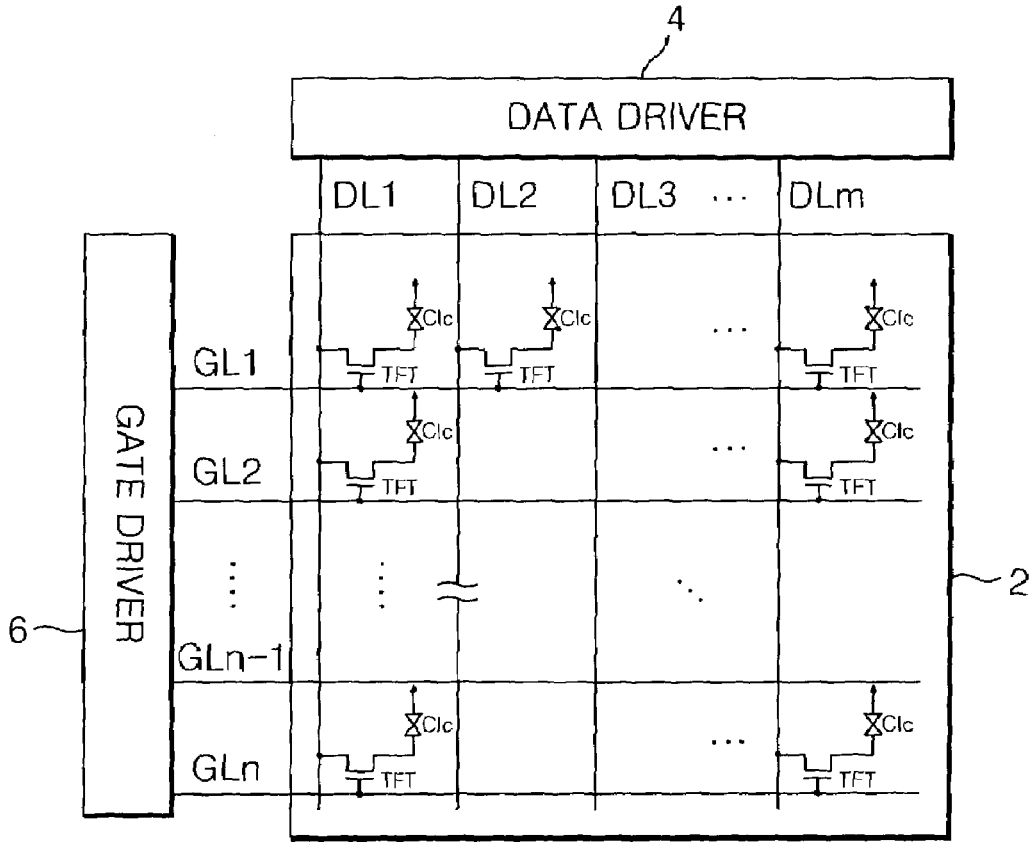
FIG. 1 RELATED ART
FIG. 1 illustrates a related art liquid crystal display device.

The first liquid crystal cell 10 and the first switching part 14 are formed on the left side of the data line DL (i.e., odd-numbered vertical lines). The second liquid crystal cell 12 and the second switching part 16 are formed on the right side of the data line DL (i.e., even-numbered vertical lines). In other words, the first liquid crystal cells 10 and the second liquid crystal cells 12 are formed on the left and right sides of one data line DL, and at the same time, receive video signals from the data line DL located adjacent thereto. Therefore, in the liquid crystal display device according to the first embodiment of the present invention, the number of data lines DL are reduced to a half of that of the liquid crystal display device shown in FIG. 1. The first and second liquid crystal cells 10 and 12 include storage capacitors (not shown) connected to the previous gate line for sustaining the data voltage charged in the liquid crystal capacitor Clc until the next data voltage is charged.

Figure 4:
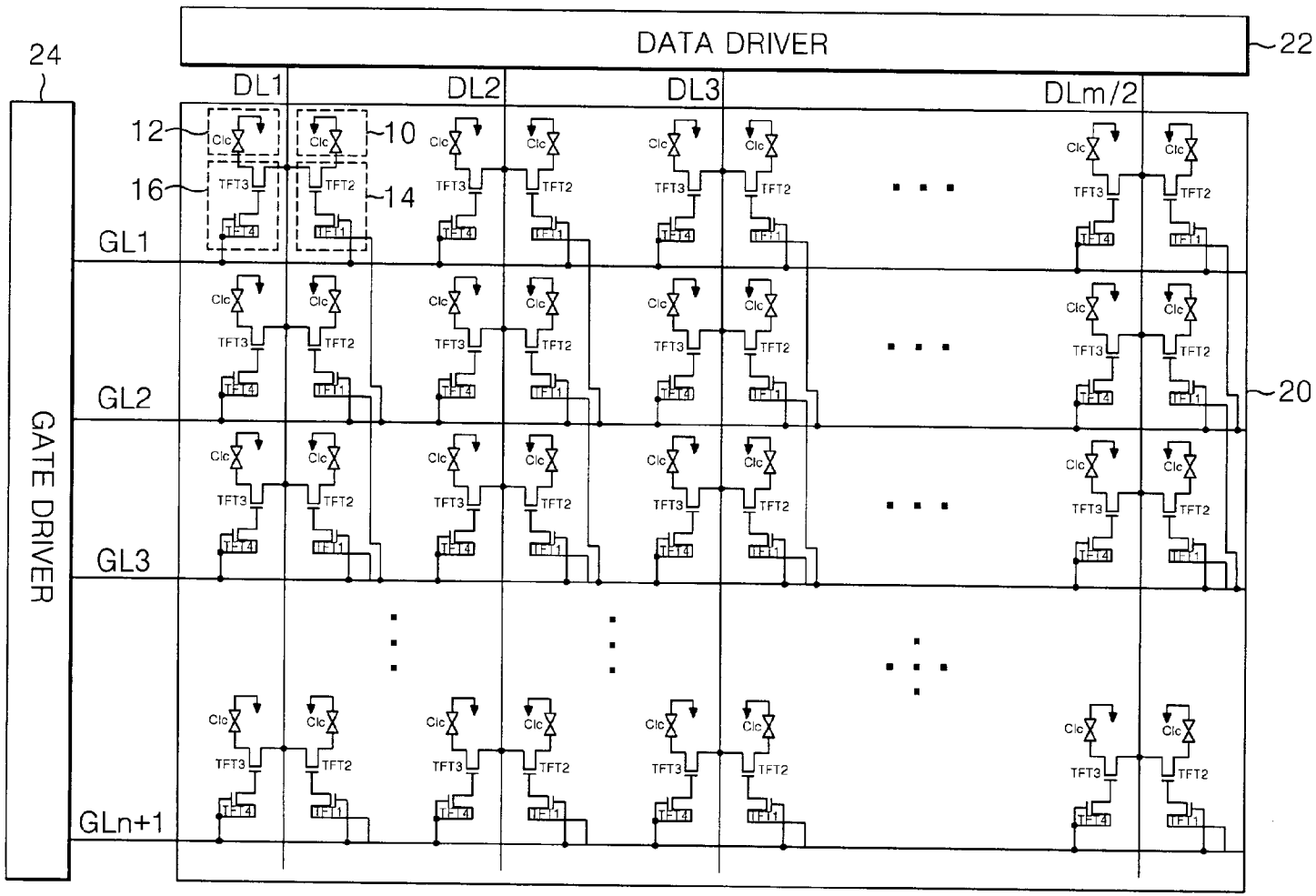
FIG. 4 illustrates a liquid crystal display device according to a second embodiment of the present invention.

On the other hand, the location of the first liquid crystal cells 10 and the second liquid crystal cells 12 can be changed as shown in FIG. 4. That is, as shown in FIG. 4, the first liquid crystal cell 10 and the first switching part 14 are formed on the right side of the data line DL, and the second liquid crystal cell 12 and the second switching part 16 are formed on the left side of the data line DL. In other words, the first liquid crystal cell 10 and the first switching part 14 are formed in the even-numbered vertical lines, and the second liquid crystal cell 12 and the second switching part 14 are formed in the odd-numbered vertical lines.

The first switching part 14 for driving the first liquid crystal cell 10 includes a first thin film transistor TFT1, and a second thin film transistor TFT2. The gate terminal of the first thin film transistor TFT1 is connected to the $i^{th}$ gate line GLi (wherein i is a natural number), and the source terminal is connected to the $(i+1)^{th}$ gate line GLi+1. The gate terminal of the second thin film transistor TFT2 is connected to the drain terminal of the first thin film transistor TFT1, and the source terminal is connected to an adjacent data line DL. And, the drain terminal of the second thin film transistor TFT2 is connected to the first liquid crystal cell 10. Accordingly, the first switching part 14 applies video signals to the first liquid crystal cell 10, when driving signals are supplied to a current gate line GLi and a next gate line GLi+1.

The second switching part 16 for driving the second liquid crystal cell 12 includes a third thin film transistor TFT3 and a fourth thin film transistor TFT4. The gate terminal and the source terminal of the fourth thin film transistor TFT4 are connected to the $i^{th}$ gate line GLi. The fourth thin film transistor TFT4 having its gate terminal and source terminal connected to the $i^{th}$ gate line GLi applies driving signals to its drain terminal, when the driving signals are supplied to the $i^{th}$ gate line GLi. In other words, the fourth thin film transistor TFT4 acts as a diode. Accordingly, the fourth thin film transistor TFT4 may be replaced by a diode. The gate terminal of the third thin film transistor TFT3 is connected to the drain terminal of the fourth thin film transistor TFT4, and the source terminal is connected to an adjacent data line DL. And, the drain terminal of the third thin film transistor TFT3 is connected to the second liquid crystal cell 12. The second switching part 16 applies video signals to the second liquid crystal cell 12 when driving signals are applied to the current gate line GLi.

Meanwhile, the fourth thin film transistor TFT4 of the second switching part 16 allows an equal voltage to be charged, when an identical video signal is applied to the first liquid crystal cell 10 and the second liquid crystal cell 12. More specifically, the second thin film transistor TFT2 of the first switching part 14 receives a driving signal—a gate signal to be applied to the next gate line—through the first thin film transistor TFT1. In other words, when the gate signal is applied to the gate terminal and the source terminal of the first thin film transistor TFT1, the second thin film transistor is supplied with the driving signal having its voltage dropped as much as the threshold voltage of the first thin film transistor TFT1.

Similarly, the third thin film transistor TFT3 receives a driving signal—a gate signal applied to a current gate line—through the fourth thin film transistor TFT4. In other words, when the gate signal is applied to the gate terminal and the source terminal of the fourth thin film transistor TFT4, the third thin film transistor TFT3 is supplied with the driving signal having its voltage dropped as much as the threshold voltage of the first thin film transistor TFT1. In other words, the fourth thin film transistor TFT4 drops the voltage of the gate signal as much as its threshold voltage, so that the gate terminal of the third thin film transistor TFT3 and the gate terminal of the second thin film transistor TFT2 are supplied with the same voltage. Accordingly, when an identical video signal is applied, the first liquid crystal cell 10 and the second liquid crystal cell 12 can be charged with the same voltage.

On the other hand, the first switching part 14 is driven by using the gate signal applied to the $i^{th}$ gate line GLi and the $(i+1)^{th}$ gate line GLi+1. And, the second switching part 16 is driven by using the gate signal applied to the $i^{th}$ gate line GLi. At this point, when the voltage value of the gate signal applied to the $i^{th}$ gate line GLi and the voltage value of the gate signal applied to the $(i+1)^{th}$ are different from each other, the driving voltage applied to the second thin film transistor TFT2 and the driving voltage applied to the third thin film transistor TFT3 become different. In this case, the driving voltage applied to the third thin film transistor TFT3 may be set to be the same as the driving voltage applied to the second thin film transistor TFT2.

Figure 5:
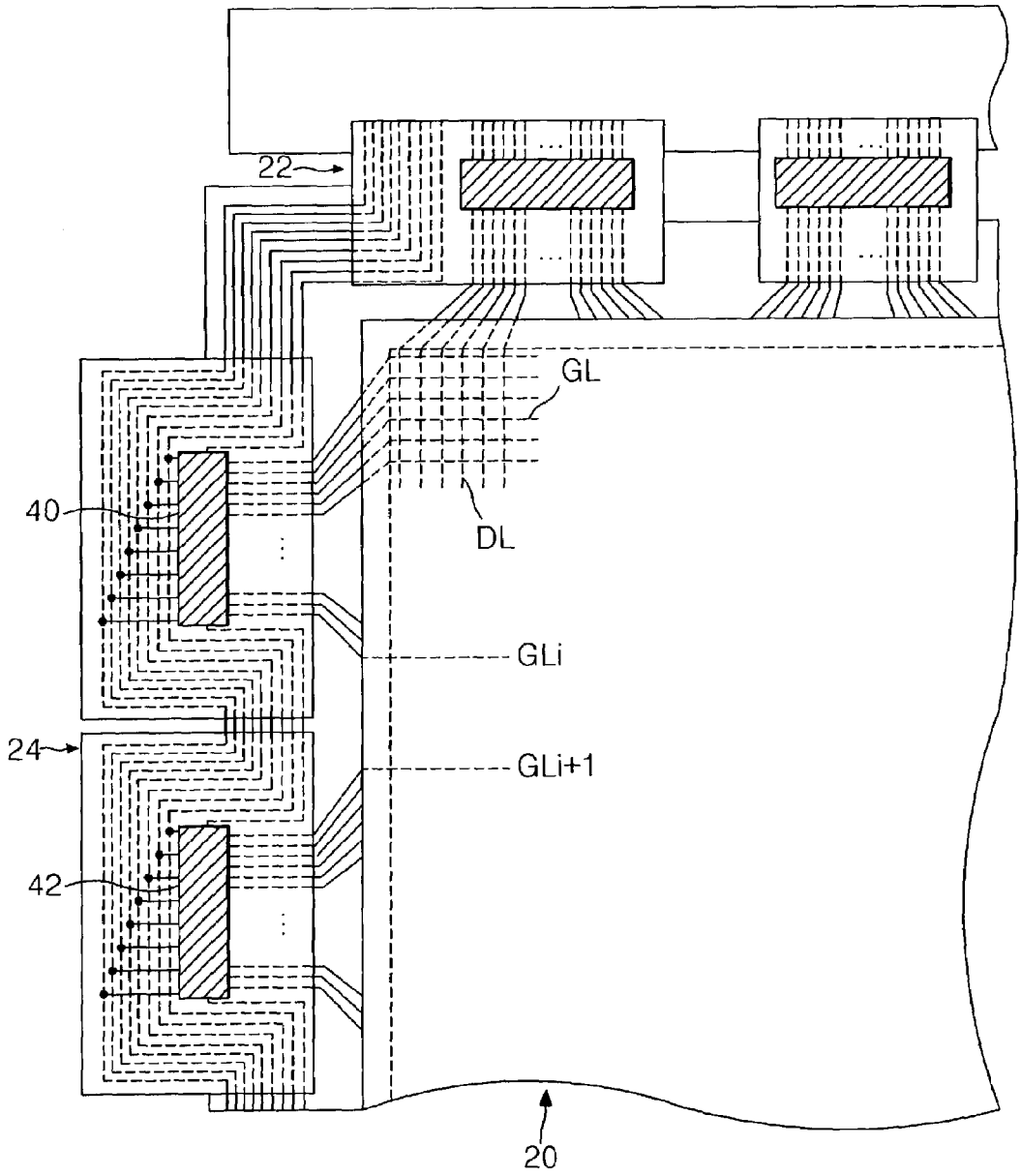
FIG. 5 illustrates a liquid crystal display device of a line-on-glass type.

An example of changing a channel width of the fourth thin film transistor TFT4 is described in detail by using a liquid crystal display device of a line-on-glass (LOG) type shown in FIG. 5. The LOG type is to transmit gate driving signals applied to gate driver IC's 40, 42, . . . , which are included in a gate driver 24, through signal lines mounted on a lower glass substrate. In the liquid crystal display device of the LOG type, a voltage difference of the gate signal is generated by a gate driver IC 40 unit. In other words, the voltage difference is generated between the gate signal applied to the gate lines GL from the first gate driver IC 40 and the gate signal applied to the gate lines GL from the second driver IC 42.

When the present invention is applied to the liquid crystal display device of the LOG type, a uniform image can be displayed in the first liquid crystal cell 10 and the second liquid crystal cell 12 by controlling the channel width of the fourth thin film transistor TFT4. More specifically, the first switching part 14 formed in the $i^{th}$ horizontal line receives the gate signal from the $i^{th}$ gate line GLi (the gate signal from the first gate driver IC 40) and the $(i+1)^{th}$ gate line GLi+1 (the gate signal from the second gate driver IC 42). However, the second switching part 16 formed in the $i^{th}$ horizontal line receives the gate signal from the $i^{th}$ gate line GLi. Accordingly, the driving voltage applied to the second thin film transistor TFT2 becomes different from the driving voltage applied to the third thin film transistor TFT3. In this case, the channel width of the fourth thin film transistor TFT4 is adjusted, so that the second and third thin film transistors TFT2 and TFT3 can be supplied with the same driving voltage.

On the other hand, a first switching part 14 and a second switching part 16 shown in FIG. 2 are symmetrical in structure (i.e., a mirror image) except for the connections of the source terminal of a first thin film transistor TFT1 and the source terminal of a fourth thin film transistor TFT4.

Figure 3:
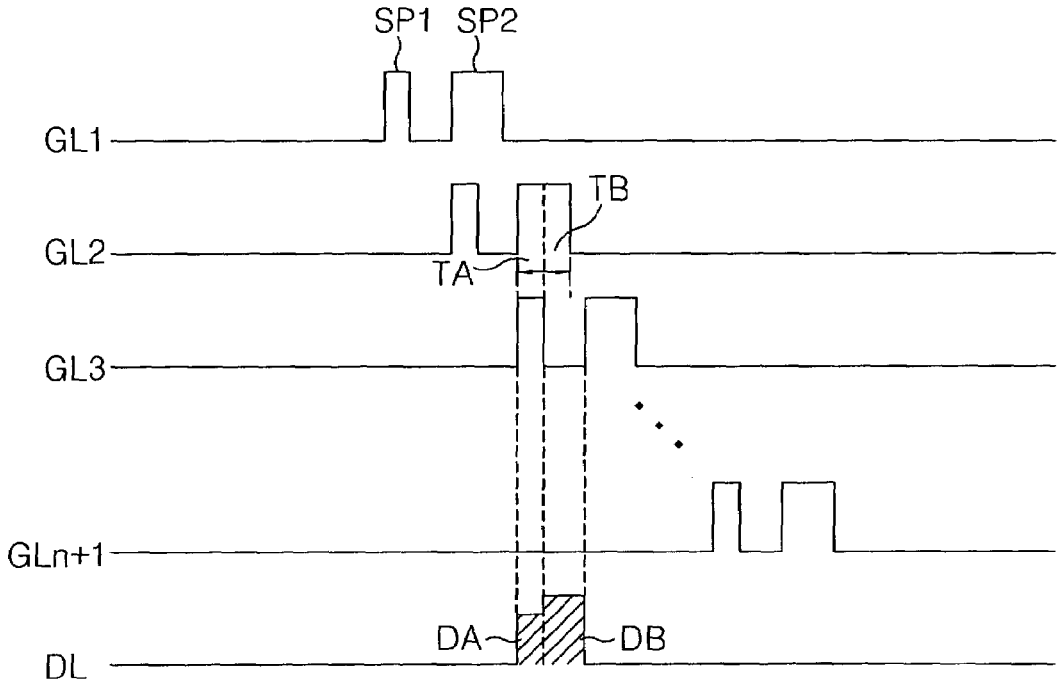
FIG. 3 is a waveform diagram illustrating gate signals applied to the gate lines shown in FIG. 2.

As shown in FIG. 3, the gate driver 24 applies a first gate signal SP1 and a second gate signal SP2 to the gate lines GL1 to GLn+1 in accordance with control signals applied from a timing controller (not shown). Herein, a width of the first gate signal SP1 is narrower than that of the second gate signal SP2.

The data driver 22 converts data R, G, and B supplied from the timing controller into video signals as analog signals, which are then applied to the data lines DL1 to DLm/2. At this time, since the number of data lines DL1 to DLm/2 is decreased to a half of that of the liquid crystal display device shown in FIG. 1, the number of data driver IC's, which is included in the data driver 22, is also decreased by a half.

To more specifically describe a driving process of the liquid crystal display device according to the first embodiment of the present invention, the gate driver 24 sequentially applies the first gate signal SP1 and the second gate signal SP2. At this moment, the second gate signal SP2 applied to the previous gate line overlaps the first gate signal SP1 applied to the current gate line.

In other words, when the second gate signal SP2 is applied to the second gate line GL2, the first gate signal SP1 is applied to the third gate line GL3. Herein, since a width of the second gate signal SP2 is wider than that of the first gate signal SP1, the first and second gate signals SP1 and SP2 are simultaneously applied during a first period TA, and only the second gate signal SP2 is applied during a second period TB subsequent to the first period TA.

During the first period TA, when the second gate signal SP2 is applied to the second gate line GL2 and the first gate signal SP1 is applied to the third gate line GL3, the first thin film transistor TFT1 and the second thin film transistor TFT2 are turned on, thereby applying a first video signal DA to the first liquid crystal cell 10 located in the second horizontal line.

More specifically, the first gate signal SP1 applied to the third gate line GL3 is applied to the source terminal of the first thin film transistor TFT1, the gate terminal of which is connected to the second gate line GL2 (i.e., located at the second horizontal line). At this moment, the second gate signal SP2 applied to the second gate line GL2 turns on the first thin film transistor TFT1. As a result, the first gate signal SP1 applied to the drain terminal of the first thin film transistor TFT1 is applied to the gate terminal of the second thin film transistor TFT2 so as to turn on the second thin film transistor TFT2. When the second thin film transistor TFT2 is turned on, the first video signal DA applied to the data line DL is supplied to the liquid crystal capacitor Clc of the first liquid crystal cell 10 through the second thin film transistor TFT2. In other words, the first liquid crystal cell 10 located in the $i^{th}$ horizontal line receives the video signal, when the second gate signal SP2 is applied to the $i^{th}$ gate line GLi and the first gate signal SP1 is applied to the $(i+1)^{th}$ gate line GLi+1.

Subsequently, during the second period TB when only the second gate signal SP2 is applied to the second gate line GL2, the third and fourth thin film transistors TFT3 and TFT4 are turned on, and then a second video signal DB is applied to the second liquid crystal cell 12 located in the second horizontal line.

More specifically, the gate terminal and the source terminal of the fourth thin film transistor TFT4 are supplied with the second gate signal SP2 during the second period TB. When the second gate signal SP2 is applied to the gate and source terminals of the fourth thin film transistor TFT4, the fourth thin film transistor TFT4 is turned on, thereby applying the second gate signal SP2 to the gate terminal of the third thin film transistor TFT3. At this moment, the third thin film transistor TFT3 receiving the second gate signal SP2 is turned on. When the third thin film transistor TFT3 is turned on, the second video signal DB applied to the data line DL is applied to the liquid crystal capacitor Clc of the second liquid crystal cell 12 through the third thin film transistor TFT3. In other words, the second liquid crystal cell 12 located in the $i^{th}$ horizontal line receives the video signal when the second gate signal SP2 is applied to the $i^{th}$ gate line.

On the other hand, since the second liquid crystal cell 12 receives the second gate signal SP2 even during the first period TA, the first video signal DA is charged during the first period TA. However, since the second video signal DB is applied during the second period TB subsequent to the first period TA, the second liquid crystal cell 12 can be charged with a desired video signal DB.

Figure 6:
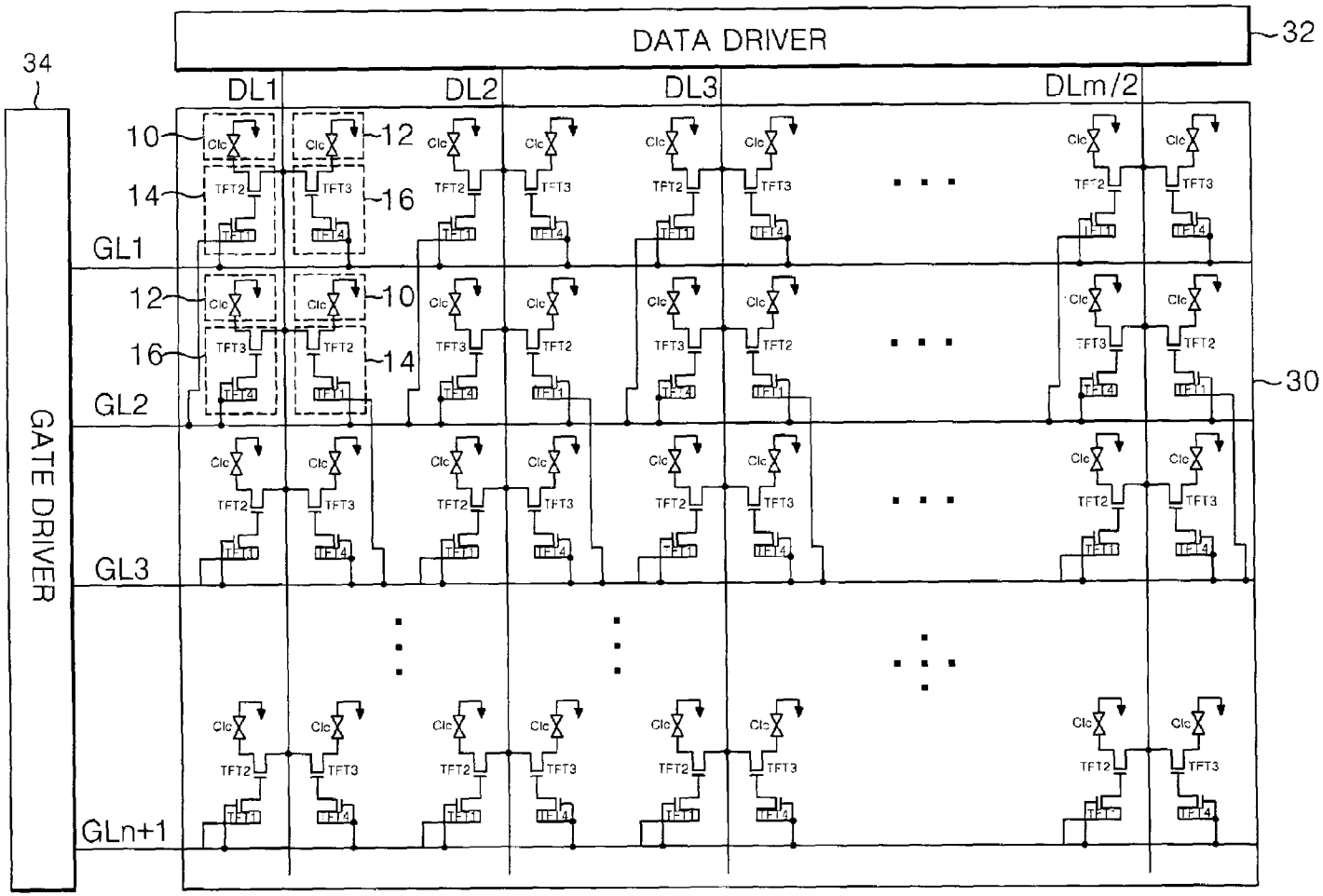
FIG. 6 illustrates a liquid crystal display device according to a third embodiment of the present invention.

FIG. 6 illustrates a schematic view of a liquid crystal display device according to a third embodiment of the present invention. In this embodiment, the locations of the liquid crystal cells 10 and 12 and the switching parts 14 and 16 is different from those of the first embodiment in FIG. 2, and the structures and functions are similar to the first embodiment in FIG. 2.

Referring to FIG. 6, the liquid crystal display device according to the third embodiment of the present invention includes a liquid crystal display panel 30, a data driver 32 driving data lines DL1 to DLm/2 of the liquid crystal display panel 30, and a gate driver 34 driving gate lines GL1 to GLn+1 of the liquid crystal display panel 30.

The liquid crystal display panel 30 includes first liquid crystal cells 10 and second liquid crystal cells 12 formed at the intersections of the gate lines GL1 to GLn+1 and the data lines DL1 to DLm/2, first switching parts 14 driving the first liquid crystal cells 10, and second switching parts 16 driving the second liquid crystal cells 12. In this embodiment of the present invention, the first liquid crystal cell 10 and the first switching part 14 and the second liquid crystal cell 12 and the second switching part 16 are alternately arranged with respect to the data line DL.

As shown in FIG. 6, the first liquid crystal cell 10 and the first switching part 14 are located in the odd-numbered vertical lines of the odd-numbered horizontal lines, and the second liquid crystal cell 12 and the second switching part 16 are located in the even-numbered vertical lines of the odd-numbered horizontal lines. And, the first liquid crystal cell 10 and the first switching part 14 are located in the even-numbered vertical lines of the even-numbered horizontal lines, and the second liquid crystal cell 12 and the second switching part 16 are located in the odd-numbered vertical lines of the even-numbered horizontal lines.

Figure 7:
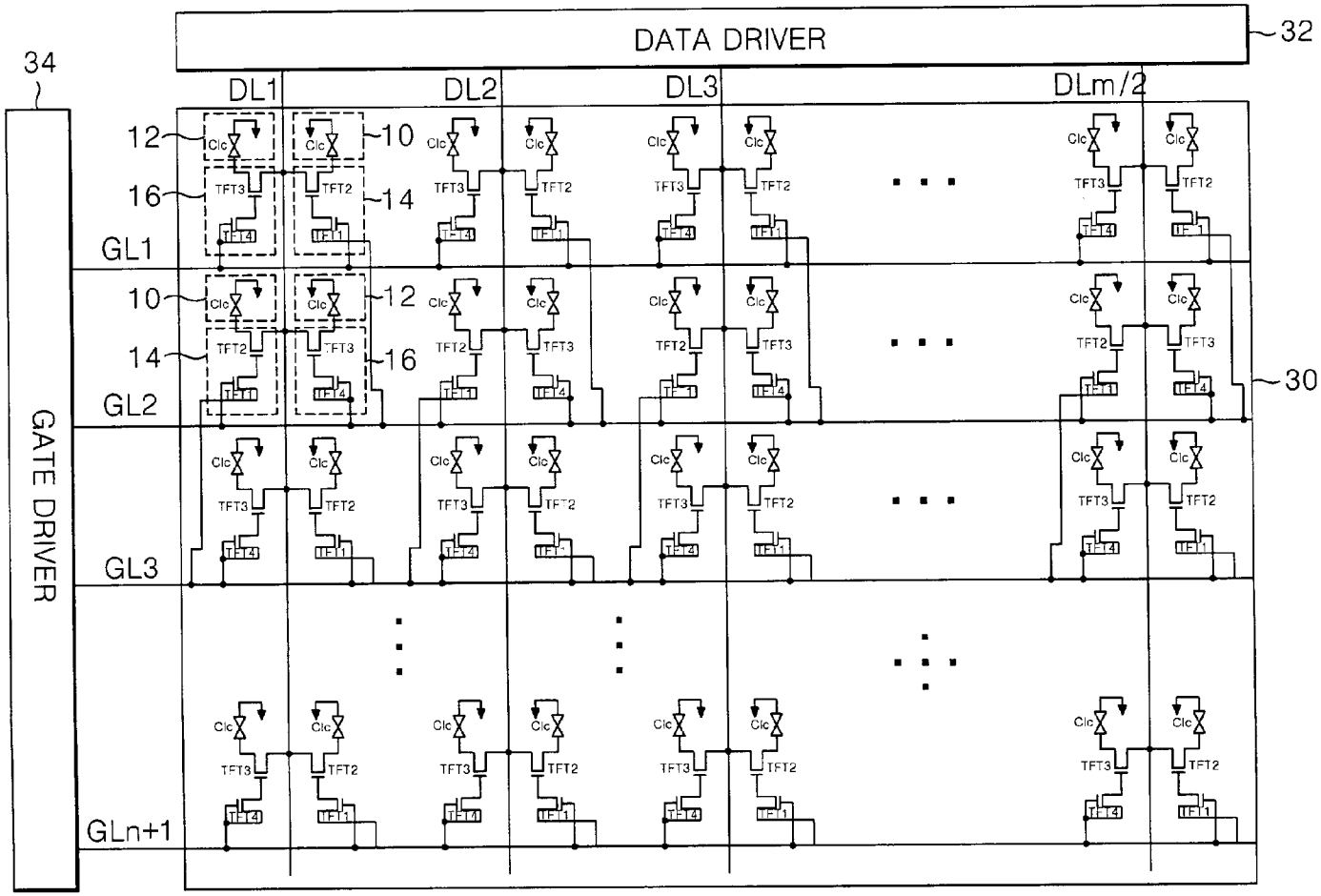
FIG. 7 illustrates a liquid crystal display device according to a fourth embodiment of the present invention.

In a fourth embodiment of the present invention, as shown in FIG. 7, the first liquid crystal cell 10 and the first switching part 14 are located in the even-numbered vertical lines of the odd-numbered horizontal lines, and the second liquid crystal cell 12 and the second switching part 16 are located in the odd-numbered vertical lines of the odd-numbered horizontal lines. And, the first liquid crystal cell 10 and the first switching part 14 are located in the odd-numbered vertical lines of the even-numbered horizontal lines, and the second liquid crystal cell 12 and the second switching part 16 are located in the even-numbered vertical lines of the even-numbered horizontal lines.

In this way, the first liquid crystal cells 10 and the second liquid crystal cells 12, which are alternately arranged with respect to the data line DL, receive the video signal from the adjacent data line DL (i.e., the base data line). Therefore, in the liquid crystal display device according to the fourth embodiment of the present invention, the number of data line DL is reduced to a half of that of the liquid crystal display device shown in FIG. 1.

The first switching part 14 driving the first liquid crystal cell 10 includes a first thin film transistor TFT1 and a second thin film transistor TFT2. The gate terminal of the first thin film transistor TFT1 is connected to the $i^{th}$ gate line GLi (wherein i is a natural number), and the source terminal is connected to the $(i+1)^{th}$ gate line GLi+1. The gate terminal of the second thin film transistor TFT2 is connected to the drain terminal of the first thin film transistor TFT1, and the source terminal is connected to the adjacent data line DL. And, the drain terminal of the second thin film transistor TFT2 is connected to the first liquid crystal cell 10. Accordingly, the first switching part 14 applies video signals to the first liquid crystal cell 10, when driving signals are supplied to the current gate line GLi and the next gate line GLi+1.

The second switching part 16 driving the second liquid crystal cell 12 includes a third thin film transistor TFT3 and a fourth thin film transistor TFT4. The gate terminal and the source terminal of the fourth thin film transistor TFT4 are connected to the $i^{th}$ gate line GLi. Accordingly, the fourth thin film transistor TFT4 having its gate terminal and source terminal connected to the $i^{th}$ gate line GLi applies driving signals to its drain terminal, when the driving signals are supplied to the $i^{th}$ gate line GLi. In other words, the fourth thin film transistor TFT4 acts as a diode. Therefore, the fourth thin film transistor TFT4 may be replaced by a diode. The gate terminal of the third thin film transistor TFT3 is connected to the drain terminal of the fourth thin film transistor TFT4, and the source terminal is connected to the adjacent data line DL. And, the drain terminal of the third thin film transistor TFT3 is connected to the second liquid crystal cell 12. In this way, the second switching part 16 applies video signals to the second liquid crystal cell 12 when driving signals are applied to the current gate line GLi.

Meanwhile, the fourth thin film transistor TFT4 of the second switching part 16 allows an equal voltage to be charged when the same video signal is applied to the first liquid crystal cell 10 and the second liquid crystal cell 12. More specifically, the second thin film transistor TFT2 of the first switching part 14 receives a driving signal—a gate signal to be applied to the next gate line—through the first thin film transistor TFT1. In other words, when the gate signal is applied to the gate terminal and the source terminal of the first thin film transistor TFT1, the second thin film transistor is supplied with the driving signal having its voltage dropped as much as the threshold voltage of the first thin film transistor TFT1.

Similarly, the third thin film transistor TFT3 receives a driving signal—a gate signal applied to the current gate line—through the fourth thin film transistor TFT4. In other words, when the gate signal is applied to the gate terminal and the source terminal of the fourth thin film transistor TFT4, the third thin film transistor TFT3 is supplied with the driving signal having its voltage dropped as much as the threshold voltage of the first thin film transistor TFT1. More specifically, the fourth thin film transistor TFT4 drops the voltage of the gate signal as much as its threshold voltage, so that the gate terminal of the third thin film transistor TFT3 and the gate terminal of the second thin film transistor TFT2 can be supplied with the same driving voltage. Therefore, when an identical video signal is applied, the first liquid crystal cell 10 and the second liquid crystal cell 12 can be charged with the same voltage.

On the other hand, the first switching part 14 is driven by using the gate signal applied to the $i^{th}$ gate line GLi and the $(i+1)^{th}$ gate line GLi+1. And, the second switching part 16 is driven by using the gate signal applied to the $i^{th}$ gate line GLi. At this point, when the voltage value of the gate signal applied to the $i^{th}$ gate line GLi and the voltage value of the gate signal applied to the $(i+1)^{th}$ are different from each other, the driving voltage applied to the second thin film transistor TFT2 and the driving voltage applied to the third thin film transistor TFT3 also become different from each other. In this case, the driving voltage applied to the third thin film transistor TFT3 can be set to be the same as the driving voltage applied to the second thin film transistor TFT2.

As shown in FIG. 3, the gate driver 34 applies a first gate signal SP1 and a second gate signal SP2 to the gate lines GL1 to GLn+1 in accordance with control signals applied from the timing controller (not shown). Herein, a width of the first gate signal SP1 is narrower than that of the second gate signal.

The data driver 32 converts data R, G, and B supplied from the timing controller into video signals as analog signals and applies to the data lines DL1 to DLm/2. At this point, since the number of data lines DL1 to DLm/2 is decreased to a half of that of the liquid crystal display device shown in FIG. 1, the number of data driver IC's, which is included in the data driver 32, is also decreased by a half.

To more specifically describe the driving process of the liquid crystal display device according to the fourth embodiment of the present invention, the gate driver 34 sequentially applies the first gate signal SP1 and the second gate signal SP2. At this point, the second gate signal SP2 applied to the previous gate line overlaps the first gate signal SP1 applied to the current gate line.

Accordingly, when the second gate signal SP2 is applied to the second gate line GL2, the first gate signal SP1 is applied to the third gate line GL3. Herein, since a width of the second gate signal SP2 is wider than that of the first gate signal SP1, the first and second gate signals SP1 and SP2 are simultaneously applied during a first period TA, and only the second gate signal SP2 is applied during a second period TB subsequent to the first period TA.

During the first period TA, when the second gate signal SP2 is applied to the second gate line GL2 and the first gate signal SP1 is applied to the third gate line GL3, the first thin film transistor TFT1 and the second thin film transistor TFT2 are turned on, thereby applying a first video signal DA to the first liquid crystal cell 10 located in the second horizontal line.

More specifically, the first gate signal SP1 applied to the third gate line GL3 is applied to the source terminal of the first thin film transistor TFT having its gate terminal connected to the second gate line GL2 (i.e., located at the second horizontal line). At this point, the second gate signal SP2 applied to the second gate line GL2 turns on the first thin film transistor TFT1, thereby applying the first gate signal SP1 applied to the drain terminal of the first thin film transistor TFT1 to the gate terminal of the second thin film transistor TFT2 in order to turn on the second thin film transistor TFT2. When the second thin film transistor TFT2 is turned on, the first video signal DA applied to the data line DL is supplied to the liquid crystal capacitor Clc of the first liquid crystal cell 10 through the second thin film transistor TFT2. In other words, the first liquid crystal cell 10 located in the $i^{th}$ horizontal line receives the video signal, when the second gate signal SP2 is applied to the $i^{th}$ gate line GLi and the first gate signal SP1 is applied to the $(i+1)^{th}$ gate line GLi+1.

Subsequently, during the second period TB, when only the second gate signal SP2 is applied to the second gate line GL2, the third and fourth thin film transistors TFT3 and TFT4 are turned on, thereby applying a second video signal DB to the second liquid crystal cell 12 located in the second horizontal line.

More specifically, the gate terminal and the source terminal of the fourth thin film transistor TFT4 are supplied with the second gate signal SP2 during the second period TB. When the second gate signal SP2 is applied to the gate and source terminals of the fourth thin film transistor TFT4, the fourth thin film transistor TFT4 is turned on, so that the second gate signal SP2 is applied to the gate terminal of the third thin film transistor TFT3. At this moment, the third thin film transistor TFT3 receiving the second gate signal SP2 is turned on. When the third thin film transistor TFT3 is turned on, the second video signal DB, which is applied to the data line DL, is applied to the liquid crystal capacitor Clc of the second liquid crystal cell 12 through the third thin film transistor TFT3. In other words, the second liquid crystal cell 12 located in the $i^{th}$ horizontal line receives the video signal when the second gate signal SP2 is applied to the $i^{th}$ gate line.

Meanwhile, since the first liquid crystal cells 10 and the second liquid crystal cells 12 are alternately arranged in the fourth embodiment of the present invention, a uniform image can be displayed even though the first liquid crystal cells 10 and the second liquid crystal cells 12 are not charged with a uniform voltage. For instance, although the first liquid crystal cell 10 is charged with a voltage higher than a desired voltage, and the second liquid crystal cell 12 is charged with a voltage lower than the desired voltage. This is because the first liquid crystal cells 10 and the second liquid crystal cells 12 are alternately arranged. As a result, a voltage difference is set off by a horizontal line unit, thereby displaying a uniform image.

Figure 8:
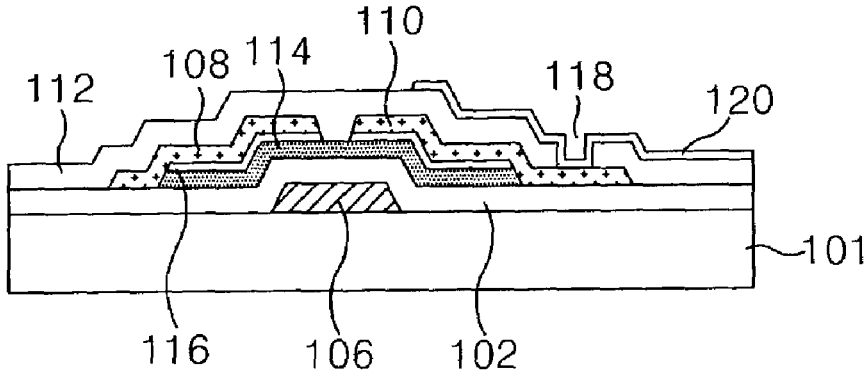
FIG. 8 is a cross-sectional view illustrating a structure of the thin film transistor of the present invention.

Each thin film transistor TFT used in the embodiments of the present invention is shown in FIG. 8.

Referring to FIG. 8, the thin film transistor TFT includes a gate electrode 106 formed on a lower substrate 101, a source electrode 108 and a drain electrode 110 formed in a different layer from the gate electrode 106. Herein, the drain electrode 110 is formed to contact a pixel electrode 120 through a drain contact hole 118. The drain electrode 110 contacts the pixel electrode 120 or the adjacent thin film transistor TFT.

An active layer 114 and an ohmic contact layer 116 (collectively called semiconductor layers) are deposited to form a conduction channel between the gate electrode 106, the source electrode 108 and the drain electrode 110. The ohmic contact layer 116 is formed between the active layer 114 and the source electrode 108, and between the active layer 114 and the drain electrode 110. The active layer 114 is formed of the amorphous silicon and not doped with impurities. The ohmic contact layer 116 is formed of the amorphous silicon and doped with impurities of n-type or p-type. The semiconductor layers 114 and 116 apply the voltage supplied to the source electrode 108 to the drain electrode 110 when a voltage is applied to the gate electrode 106. A gate insulating layer 112 is formed between the gate electrode 106 and the semiconductor layers 114 and 116. A protective layer 112 is formed on the source electrode 108 and the drain electrode 110.

The source electrode 108 and the drain electrode 110 of the thin film transistor TFT in the embodiments of the present invention are formed with a mask different from those in the semiconductor layers 114 and 116. Accordingly, the source electrode 108 and the drain electrode 110 have a pattern different from those of the semiconductor layers 114 and 116.

Figure 9:
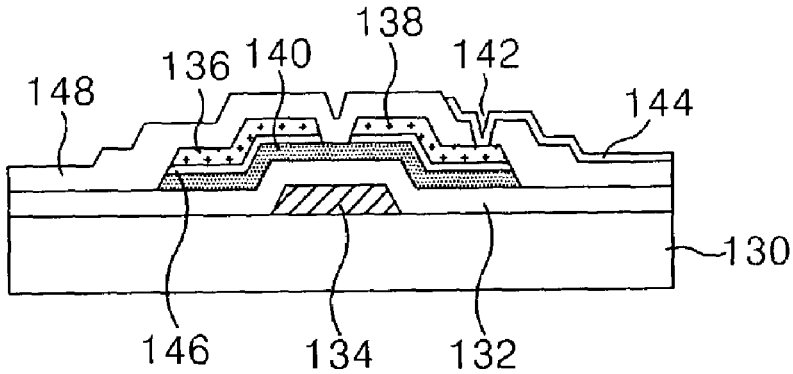
FIG. 9 is a cross-sectional view illustrating another structure of the thin film transistor of the present invention.

FIG. 9 is a cross-sectional view illustrating another structure of the thin film transistor of the present invention.

Referring to FIG. 9, the thin film transistor TFT includes a gate electrode 134 formed on a lower substrate 130, a source electrode 136 and a drain electrode 138 formed in a different layer from the gate electrode 134. Herein, the drain electrode 138 is formed to contact a pixel electrode 144 through a drain contact hole 142. The drain electrode 138 contacts the pixel electrode 144 or the adjacent thin film transistor TFT.

An active layer 140 and an ohmic contact layer 146 are deposited to form a conduction channel between the gate electrode 134, the source electrode 136 and the drain electrode 138. Herein, the active layer 140 and the ohmic contact layer 146 are collectively called semiconductor layers. The ohmic contact layer 146 is formed between the active layer 140 and the source electrode 136, and between the active layer 140 and the drain electrode 138. The active layer 104 is formed of the amorphous silicon and not doped with impurities. The ohmic contact layer 146 is formed of the amorphous silicon and doped with impurities of n-type or p-type. The semiconductor layers 140 and 146 apply the voltage supplied to the source electrode 136 to the drain electrode 138, when a voltage is applied to the gate electrode 134. A gate insulating layer 132 is formed between the gate electrode 134 and the semiconductor layers 140 and 146. A protective layer 148 is formed on the source electrode 136 and the drain electrode 138. The source electrode 136 and the drain electrode 138 of the thin film transistor TFT of the present invention are formed with the same mask as those in the semiconductor layers 140 and 146.

As described above, according to the liquid crystal display device and the driving method thereof in the present invention, a single data line drives the first and second liquid crystal cells located adjacent to each other from the left and right sides of their corresponding data line, the number of data lines is reduced by a half. Accordingly, the number of data driver IC's that apply the driving signal to the data line is also reduced by a half, thereby reducing its fabricating cost. Further, in the present invention, a uniform voltage is applied to the thin film transistors included in the first switching part and the second switching part, thereby displaying a uniform image. Furthermore, the first liquid crystal cells and the second liquid crystal cells are alternately arranged, thereby displaying a uniform image.

It will be apparent to those skilled in the art that various modifications and variations can be made in the liquid crystal display device and the driving method thereof of the present invention without departing from the spirit or scope of the inventions. Thus, it is intended that the present invention covers the modifications and variations of this invention provided they come within the scope of the appended claims and their equivalents.

What is claimed is:

1. A liquid crystal display device, comprising:

a plurality of data lines;

a plurality of gate lines crossing the data lines;

a first liquid crystal cell on a first side of a data line within the plurality of data lines;

a second liquid crystal cell on a second side of the data line;

a first switching part for applying a first video signal supplied to the data line to the first liquid crystal cell;

a second switching part for applying a second video signal supplied to the data line to the second liquid crystal cell, wherein the second switching part includes a voltage dropping device for offsetting a voltage applied to the second liquid crystal cell so that the second liquid crystal cell voltage is equal to a first liquid crystal cell voltage applied to the first liquid crystal cell when the same video signal is applied to the first liquid crystal cell and the second liquid crystal cell.

2. The liquid crystal display device according to claim 1, wherein the first switching part comprises:

a first thin film transistor having a first gate terminal connected to the $i^{th}$ (wherein i is a natural number) gate line and a first source terminal connected to the $(i+1)^{th}$ gate line; and a second thin film transistor having a second gate terminal connected to a first drain terminal of the first thin film transistor, a second source terminal connected to the data lines, and a second drain terminal connected to the first liquid crystal cell.

3. The liquid crystal display device according to claim 2, wherein the first thin film transistor is turned on to apply a second gate signal to the second thin film transistor, when a first gate signal is applied to the $i^{th}$ gate line and the second gate signal is applied to the $(i+1)^{th}$ gate line.

4. The liquid crystal display device according to claim 2, wherein each of the first and second thin film transistors comprises:

a gate electrode on a substrate;

a gate insulating layer on the gate electrode;

a semiconductor layer on the gate insulating layer;

a source electrode and a drain electrode on the semiconductor layer; and a protective layer on the source electrode and the drain electrode.

5. The liquid crystal display device according to claim 4, wherein the semiconductor layer comprises:

an undoped active layer on the gate insulating layer; and a doped ohmic contact layer on the active layer.

6. The liquid crystal display device according to claim 4, wherein the semiconductor layer, the source electrode, and the drain electrode are formed with the same mask.

7. The liquid crystal display device according to claim 4, wherein the semiconductor layer, the source electrode, and the drain electrode are formed with different masks.

8. The liquid crystal display device according to claim 1, wherein the second switching part comprises:

a third thin film transistor acting as the voltage dropping device and having a third source terminal and a third gate terminal connected to the $i^{th}$ gate line; and a fourth thin film transistor having a fourth gate terminal connected to a third drain terminal of the third thin film transistor, a fourth source terminal connected to the data lines, and a fourth drain terminal connected to the second liquid crystal cell.

9. The liquid crystal display device according to claim 8, wherein the third thin film transistor is turned on to apply a first gate signal to the fourth thin film transistor, when the first gate signal is applied to the $i^{th}$ gate line.

10. The liquid crystal display device according to claim 8, wherein each of the third and fourth thin film transistors comprises:

a gate electrode on a substrate;

a gate insulating layer on the gate electrode;

a semiconductor layer on the gate insulating layer;

a source electrode and a drain electrode on the semiconductor layer; and a protective layer on the source electrode and the drain electrode.

11. The liquid crystal display device according to claim 10, wherein the semiconductor layer comprises:

an undoped active layer on the gate insulating layer; and a doped ohmic contact layer on the active layer.

12. The liquid crystal display device according to claim 10, wherein the semiconductor layer, the source electrode, and the drain electrode are formed with the same mask.

13. The liquid crystal display device according to claim 10, wherein the semiconductor layer, the source electrode, and the drain electrode are formed with different masks.

14. The liquid crystal display device according to claim 9, wherein the third thin film transistor drops a voltage of the first gate signal applied to the fourth thin film transistor to be equal to the voltage of the second gate signal applied to the second thin film transistor.

15. The liquid crystal display device according to claim 9, wherein the voltage of the first gate signal is controlled by a channel width of the third thin film transistor.

16. The liquid crystal display device according to claim 1, wherein the second switching part comprises:

a third thin film transistor having a third source terminal connected to the data lines and a third drain terminal connected to the second liquid crystal cell; and a diode acting as the voltage dropping device and connected between the $i^{th}$ gate line and a third gate terminal of the third thin film transistor.

17. The liquid crystal display device according to claim 16, wherein the diode provides the third thin film transistor with a gate signal supplied to the $i^{th}$ gate line.

18. The liquid crystal display device according to claim 1, wherein the first switching part is located on the first side of the data lines.

19. The liquid crystal display device according to claim 18, wherein the second switching part is located on the second side of the data lines.

20. A liquid crystal display device, comprising:

a plurality of data lines;

a plurality of gate lines crossing the data lines;

a first liquid crystal cell on a first side of a data line within the plurality of data lines;

a second liquid crystal cell on a second side of the data lines;

a first switching part comprising a first thin film transistor and a second thin film transistor for applying a video signal supplied to the data line to the first liquid crystal cell; and a second switching part comprising a third thin film transistor and a fourth thin film transistor for applying the video signal supplied to the data line to the second liquid crystal cell, wherein the first switching part and the second switching part are symmetrical with each other except for a connection to source terminals of the first and third thin film transistors.

21. The liquid crystal display device according to claim 20, wherein the first thin film transistor has a first gate terminal connected to the $i^{th}$ (wherein i is a natural number) gate line and a first source terminal connected to the $(i+1)^{th}$ gate line.

22. The liquid crystal display device according to claim 20, wherein the second thin film transistor has a second gate terminal connected to a first drain terminal of the first thin film transistor, a second source terminal connected to the data lines, and a second drain terminal connected to the first liquid crystal cell.

23. The liquid crystal display device according to claim 20, wherein the third thin film transistor has a third gate terminal and a third source terminal connected the $i^{th}$ (wherein i is a natural number) gate line.

24. The liquid crystal display device according to claim 20, wherein the fourth thin film transistor has a fourth gate terminal connected to a third drain terminal of the third thin film transistor, a fourth source terminal connected to the data lines, and a fourth drain terminal connected to the second liquid crystal cell.

25. The liquid crystal display device according to claim 20, wherein the first liquid crystal cell and the first switching part are formed in odd-numbered vertical lines, and the second liquid crystal cell and the second switching part are formed in even-numbered vertical lines.

26. The liquid crystal display device according to claim 20, wherein the second liquid crystal cell and the second switching part are formed in odd-numbered vertical lines and the first liquid crystal cell, and the first switching part are formed in even-numbered vertical lines.

27. The liquid crystal display device according to claim 20, wherein each of the first to fourth thin film transistors comprises:

a gate electrode on a substrate;

a gate insulating layer on the gate electrode;

a semiconductor layer on the gate insulating layer;

a source electrode and a drain electrode on the semiconductor layer; and a protective layer on the source electrode and the drain electrode.

28. The liquid crystal display device according to claim 27, wherein the semiconductor layer comprises:

an undoped active layer on the gate insulating layer; and a doped ohmic contact layer on the active layer.

29. The liquid crystal display device according to claim 27, wherein the semiconductor layer, the source electrode, and the drain electrode are formed with the same mask.

30. The liquid crystal display device according to claim 27, wherein the semiconductor layer, the source electrode, and the drain electrode are formed with different masks.

31. A liquid crystal display device, comprising:

a plurality of data lines;

a plurality of gate lines crossing the data lines;

a first liquid crystal cell on a first side of a data line within the plurality of data lines;

a second liquid crystal cell on a second side of the data line;

a first switching part comprising a first thin film transistor connected to the $i^{th}$ (wherein i is a natural number) gate line and the $(i+1)^{th}$ gate line, and a second thin film transistor connected to the first thin film transistor for applying a video signal from the data to the first liquid crystal cell; and a second switching part comprising a third thin film transistor connected to the $i^{th}$ gate line, and a fourth thin film transistor connected to the third thin film transistor for applying the video signal from the data line to the second liquid crystal cell, wherein a channel width of the third thin film transistor is adjusted, so that a voltage charged in the first liquid crystal cell is the same as the voltage charged in the second liquid crystal cell, when the first and second liquid crystal cells are supplied with the same video signal.

32. A liquid crystal display device, comprising:

a plurality of data lines;

a plurality of gate lines crossing the data lines;

a first liquid crystal cell on a first side of a data line within the plurality of data lines;

a second liquid crystal cell on a second side of the data line;

a first switching part comprising a first thin film transistor connected to the $i^{th}$ (wherein i is a natural number) gate line and the $(i+1)^{th}$ gate line, and a second thin film transistor connected to the first thin film transistor for applying a video signal from the data line to the first liquid crystal cell; and a second switching part comprising a third thin film transistor connected to the $i^{th}$ gate line, and a fourth thin film transistor connected to the third thin film transistor for applying the video signal from the data line to the second liquid crystal cell, wherein the first switching part and the second switching part are alternately arranged with respect to the data lines.

33. The liquid crystal display device according to claim 32, wherein the first liquid crystal cell and the first switching part are located in odd-numbered vertical lines of even-numbered horizontal lines, and the second liquid crystal cell and the second switching part are located in even-numbered vertical lines of even-numbered horizontal lines.

34. The liquid crystal display device according to claim 32, wherein the first liquid crystal cell and the first switching part are located in even-numbered vertical lines of odd-numbered horizontal lines, and the second liquid crystal cell and the second switching part are located in odd-numbered vertical lines of odd-numbered horizontal lines.

35. The liquid crystal display device according to claim 32, wherein the first liquid crystal cell and the first switching part are located in odd-numbered vertical lines of odd-numbered horizontal lines, and the second liquid crystal cell and the second switching part are located in even-numbered vertical lines of odd-numbered horizontal lines.

36. The liquid crystal display device according to claim 32, wherein the first liquid crystal cell and the first switching part are located in even-numbered vertical lines of even-numbered horizontal lines, and the second liquid crystal cell and the second switching part are located in odd-numbered vertical lines of even-numbered horizontal lines.

37. A method of driving a liquid crystal display device, comprising:

applying a video signal supplied from a data line in a first switching part to a first liquid crystal cell, when a gate signal is applied to the $i^{th}$ gate line and the $(i+1)^{th}$ gate line;

applying the video signal supplied from the data line in a second switching part to a second liquid crystal cell, when the gate signal is applied to the $i^{th}$ gate line; and dropping a voltage of the gate signal applied from the second switching part for supplying a uniform video signal to the first and second liquid crystal cells.

* * * * *